US010215416B2

(12) United States Patent
Dusing et al.

(10) Patent No.: US 10,215,416 B2
(45) Date of Patent: Feb. 26, 2019

(54) BURNER OF A GAS TURBINE WITH A LOBED SHAPE VORTEX GENERATOR

(71) Applicant: ANSALDO ENERGIA SWITZERLAND AG, Baden (CH)

(72) Inventors: Michael Dusing, Rheinfelden (DE); Madhavan Narasimhan Poyyapakkam, Rotkreuz (CH); Stefan Wysocki, Zurich (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 291 days.

(21) Appl. No.: 14/950,759

(22) Filed: Nov. 24, 2015

(65) Prior Publication Data

US 2016/0146470 A1 May 26, 2016

(30) Foreign Application Priority Data

Nov. 26, 2014 (EP) ..... 14194930

(51) Int. Cl.

| | |
|---|---|
| ***F23R 3/28*** | (2006.01) |
| ***F23R 3/12*** | (2006.01) |
| ***F23R 3/14*** | (2006.01) |
| ***F23R 3/20*** | (2006.01) |
| ***F23R 3/46*** | (2006.01) |

(52) U.S. Cl.

CPC ..... *F23R 3/286* (2013.01); *F23R 3/12* (2013.01); *F23R 3/14* (2013.01); *F23R 3/20* (2013.01); *F23R 3/28* (2013.01); *F23R 3/283* (2013.01); *F23R 3/46* (2013.01); *F23C 2900/07001* (2013.01); *F23R 2900/03341* (2013.01)

(58) Field of Classification Search

CPC .. F23R 3/286; F23R 3/283; F23R 3/20; F23R 3/14; F23R 3/28; F23R 3/12; F23C 2900/07001

See application file for complete search history.

(56) References Cited

U.S. PATENT DOCUMENTS 3,620,012 A * 11/1971 Wilde ..... F23R 3/007 60/749
3,973,395 A * 8/1976 Markowski ..... F23R 3/34 431/352

(Continued)

FOREIGN PATENT DOCUMENTS

EP 1 894 616 A1 3/2008
EP 2 211 109 A1 7/2010

(Continued)

OTHER PUBLICATIONS

Extended Search Report dated May 8, 2015, by the European Patent Office for Application No. 14194930.5.

(Continued)

*Primary Examiner* — Carlos A Rivera
(74) *Attorney, Agent, or Firm* — Buchanan Ingersoll & Rooney PC

(57) ABSTRACT

The burner of a gas turbine has a duct, a vortex generator extending in the duct and including a leading edge and a trailing edge. The trailing edge has a first order lobed shape. The first order lobed shape is defined by a second order lobed shape. Preferably a nozzle for fuel injection is connected to the vortex generator and the second order lobed shape is only provided at the nozzles.

15 Claims, 5 Drawing Sheets

(56) References Cited

U.S. PATENT DOCUMENTS

| | | | | |
|---|---|---|---|---|
| 4,830,315 | A * | 5/1989 | Presz, Jr. | B64C 21/10 114/102.29 |
| 5,315,815 | A * | 5/1994 | McVey | F23R 3/12 239/402.5 |
| 6,655,145 | B2 * | 12/2003 | Boardman | F23R 3/14 60/737 |
| 2006/0230764 | A1 * | 10/2006 | Schmotolocha | F02K 3/10 60/761 |
| 2009/0272117 | A1 * | 11/2009 | Wilbraham | F23C 7/004 60/748 |
| 2009/0320485 | A1 * | 12/2009 | Wilbraham | F23R 3/14 60/748 |
| 2012/0260622 | A1 * | 10/2012 | Poyyapakkam | F23C 5/08 60/39.465 |
| 2012/0272659 | A1 | 11/2012 | Syed et al. | |
| 2012/0285172 | A1 | 11/2012 | Poyyapakkam et al. | |
| 2012/0285173 | A1 * | 11/2012 | Poyyapakkam | F23C 7/004 60/772 |
| 2012/0297777 | A1 | 11/2012 | Poyyapakkam et al. | |
| 2015/0013339 | A1 | 1/2015 | Ciani et al. | |

FOREIGN PATENT DOCUMENTS

| | | | |
|---|---|---|---|
| EP | 2 644 997 | A1 | 10/2013 |
| WO | WO 2011/054757 | A2 | 5/2011 |
| WO | WO 2011/054766 | A2 | 5/2011 |
| WO | WO 2011/054771 | A2 | 5/2011 |

OTHER PUBLICATIONS

Communication pursuant to Article 94(3) EPC dated Jul. 17, 2018, by the European Patent Office in corresponding European Patent Application No. 14 194 930.5. (6 pages).

* cited by examiner

BURNER OF A GAS TURBINE WITH A LOBED SHAPE VORTEX GENERATOR

TECHNICAL FIELD

The present invention relates to a burner of a gas turbine. Preferably but not necessarily the burner is arranged for quickly mixing a liquid or gas fuel with air or hot gas (cooling air is usually mixed as well), such that the mixture of fuel and air/hot gas auto ignites and combusts in a premixed fashion.

BACKGROUND

In order to correctly combust a fuel with air in a combustion chamber of a gas turbine the fuel and air/hot gas are usually supplied into one or more burners, which are located upstream of a combustion chamber; in the burner air/hot gas and fuel are mixed and the mixture is then combusted in a combustion chamber.

For a correct combustion (premixed combustion) mixing must be such that fuel and air/hot gas generate a homogeneous mixture, even with the constraints imposed by the space limitations of a burner of a gas turbine.

In order to quickly mix fuel and air/hot gas, the burners have a duct which includes structures creating turbulence. The air/hot gas passes through these structures acquiring turbulence; the fuel is injected in the turbulent flow such that quick mixing is achieved with the air/hot gas. In the following the structures creating turbulence are referred to as vortex generators.

EP 2 496 884 discloses vortex generators having walls with a substantially straight or curved leading edge and a trailing edge with a lobed shape.

U.S. Pat. No. 8,528,337 discloses nozzles with nozzle walls with a trailing edge having a first order lobed shape in turn defined by a second order lobed shape. For example FIG. 8 of U.S. Pat. No. 8,528,337 shows this arrangement.

The inventors have found a way to improve the performances in terms of mixing of the vortex generators of the kind described in EP 2 496 884.

In addition, since manufacturing of vortex generators whose trailing edge has more than one lobed shape is complex and expensive, in a particular embodiment the inventors have found a way to combine the advantages of vortex generators with first, second and possibly further order lobed shape with reduced manufacturing complexity and costs.

SUMMARY

An aspect of the invention includes providing a burner that provides better mixing performances than the burners of the prior art.

These and further aspects are attained by providing a burner in accordance with the accompanying claims.

In an embodiment of the invention the burner has a second order lobed shape only in the vicinity of the nozzles; this embodiment is easy and cheap to manufacture but at the same time allows quick mixing.

BRIEF DESCRIPTION OF THE DRAWINGS

Further characteristics and advantages will be more apparent from the description of a preferred but non-exclusive embodiment of the burner, illustrated by way of non-limiting example in the accompanying drawings, in which.

DETAILED DESCRIPTION OF EXEMPLARY EMBODIMENTS

With reference to the figures, these show a burner 1 of a gas turbine comprising a duct 2 and one or more vortex generators 3 extending in the duct 2. The vortex generators can be connected at one or more ends to the duct 2 and/or a central body, which is inserted into the duct.

The burner 1 can be a reheat burner, i.e. a burner receiving hot gas still containing oxygen from another upstream burner; in this case the gas turbine configuration is typically but not exclusively a compressor, first burner, first combustion chamber, high pressure turbine, reheat burner, second combustion chamber, low pressure turbine; the reheat burner can also receive hot gas from another gas turbine, in this case the configuration is first gas turbine whose flue gas is supplied to a second gas turbine having the reheat burner. Naturally the burner 1 can also be supplied with air or another gas containing an oxidizer.

Figure 7:
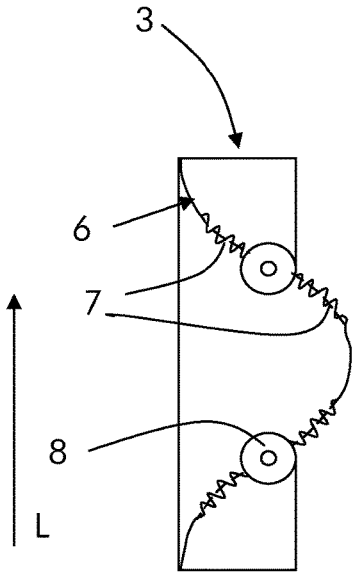
FIGS. 7 and 8 show a rear view and a side view of the vortex generator section of FIG. 4.
Figure 8:
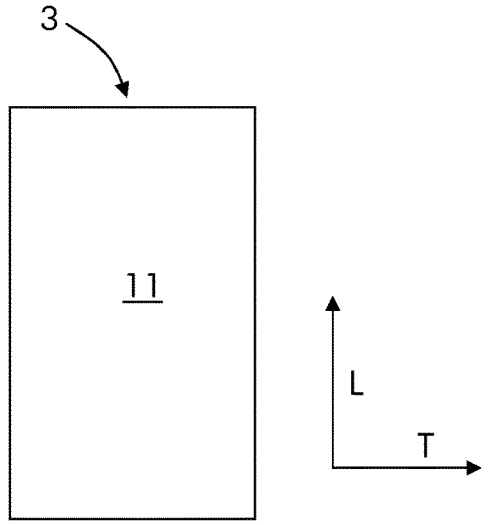
Figure 9:
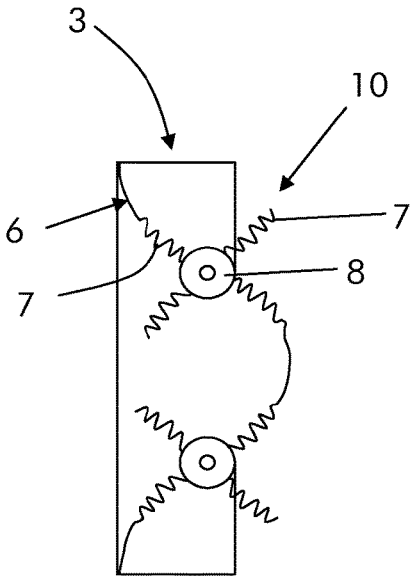
FIGS. 9 through 12 show a vortex generator section with additional walls in different embodiments.
Figure 15:
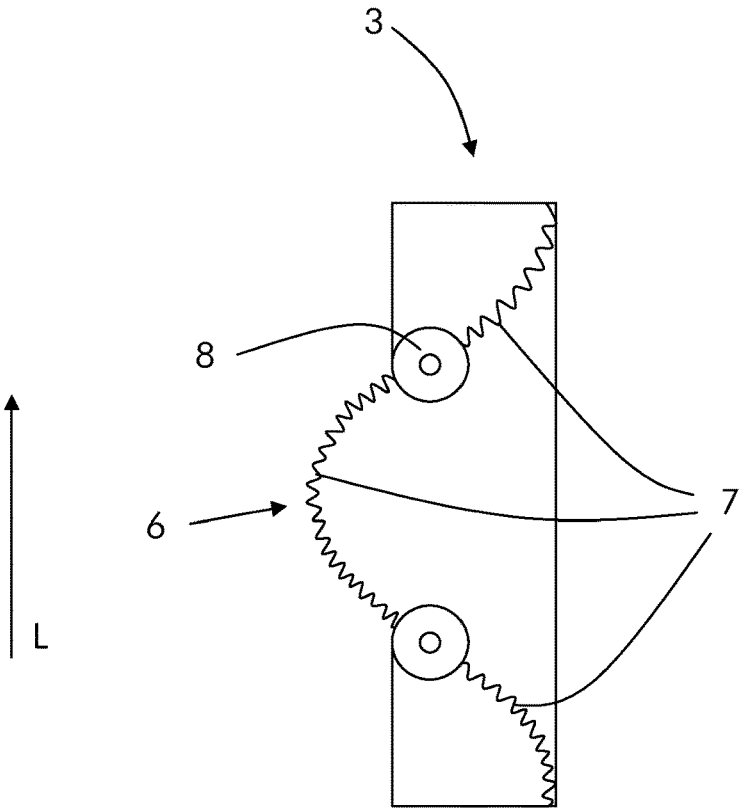
FIG. 15 shows a rear view of a section of a vortex generator having a wall with second order lobed shape extending through the whole first order lobed shape.

The vortex generators 3 have a longitudinal elongated (along the axis L) and transversally streamline (along the axis T) shape with a leading edge 4 and a trailing edge 5. Thereby neither axis L nor T necessarily need to be straight and/or orthogonal respectively in line with the main flow. The trailing edge 5 has a first order lobed shape 6, wherein the first order lobed shape 6 is defined by a second order lobed shape 7. For clarity, FIG. 7 shows the first order lobed shape and the second order lobed shape of the trailing edge; in addition the dashed line shows the first order profile in the zone where the trailing edge has the second order lobed shape. The second order lobed shape can extend over the whole first order lobed shape (FIG. 15) or only a part thereof (FIGS. 7, 9, 11, 12)

The vortex generator 3 further has at least one or typically more nozzles 8 for fuel injection.

The second order lobed shape 7 can be only provided in the vicinity of the nozzles 8. This way, the complexity and costs associated to manufacturing of the first and second order lobed shape 7 are limited to selected zones around the nozzles 8. The mixing is not affected by this configuration, because the fuel is injected from the nozzles 8 and is mixed with air or hot gas around the nozzles 8; therefore high turbulence around the nozzles 8 helps mixing whereas high turbulence at a small length scale (achievable via second order and possibly further order lobed shape) at zones apart from the nozzles 8 will be dissipated before it reaches the fuel and therefore only allows a limited contribution to the mixing.

In addition, the second order lobed shape 7 can also be defined by a third order lobed shape 9; further order shapes are also possible. Also in this case the third and the possible further order lobed shapes of the trailing edge are preferably provided in the vicinity of the nozzles 8.

An additional wall 10, also having a lobed shape, can be connected to the vortex generator 3.

The additional wall 10 is preferably connected to the vortex generators 3 at the nozzles 8, i.e. at a position close to the nozzles 8; this way the turbulence generated by the additional walls 10 is around the nozzles 8, such that mixing of fuel with air/hot gas is increased.

For example, the additional wall 10 can be connected to the nozzles 8 and/or to a wall 11 between the leading edge 4 and trailing edge 5 of the vortex generator 3.

Figure 10:
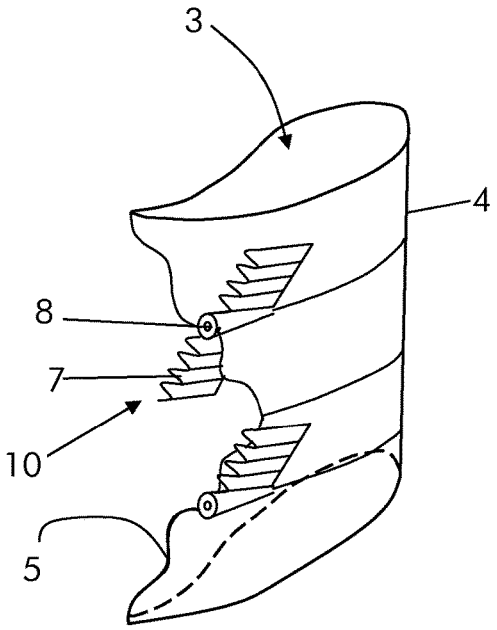
Figure 11:
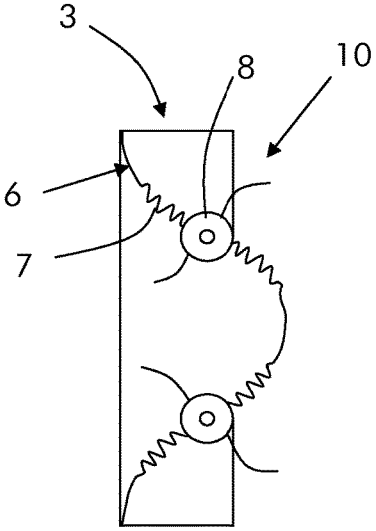
Figure 12:
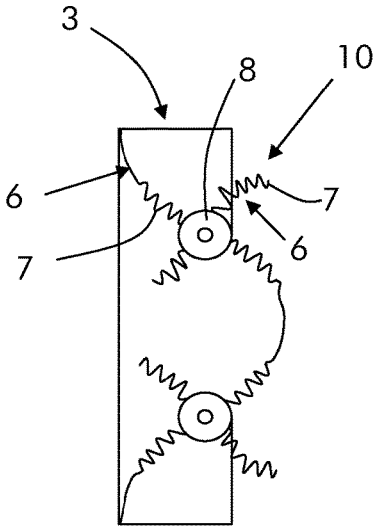
Figure 13:
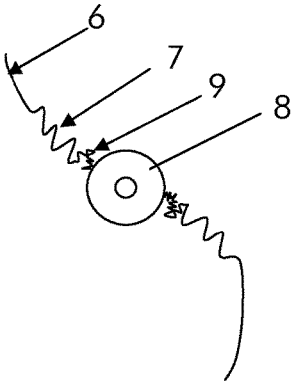
FIG. 13 shows a part of the vortex generator whose trailing edge has a first, second and third order lobed shape.
Figure 16:
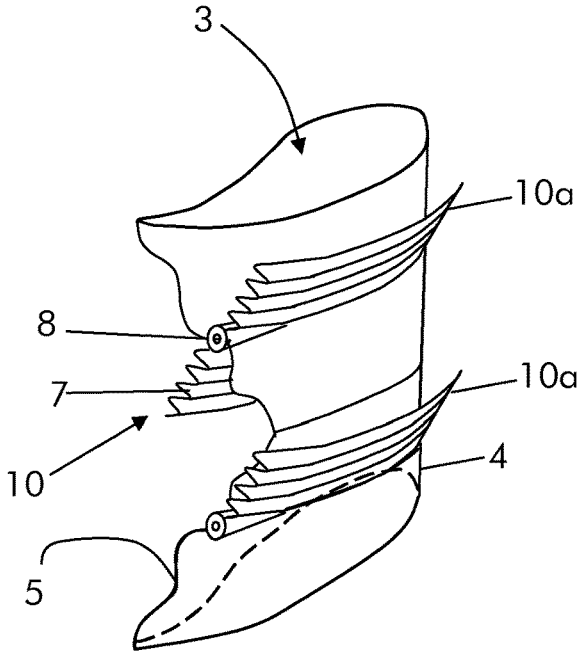
FIG. 16 shows another embodiment of a vortex generator with an additional wall.

For example the additional walls 10 can have the first order lobed shape (FIG. 11) or the second order lobed shape (FIGS. 9, 10) or it can have the first order lobed shape in turn defined by a second order lobed shape (FIG. 12). Further order lobed shapes are also possible (FIG. 13) and the second, third and the possible further order lobed shapes of the trailing edge 5 are preferably provided at the nozzle 8. In addition or as an alternative, the additional wall 10 can have order lobed shapes different from the first and/or second and/or further order lobed shape. FIG. 16 shows an embodiment with additional walls 10 having leading edge 10*a* extending from the leading edge 4. It is thus clear that the additional wall 10 can have the leading edge 10*a* extending from the leading edge 4 or from a position downstream of it.

Figure 14:
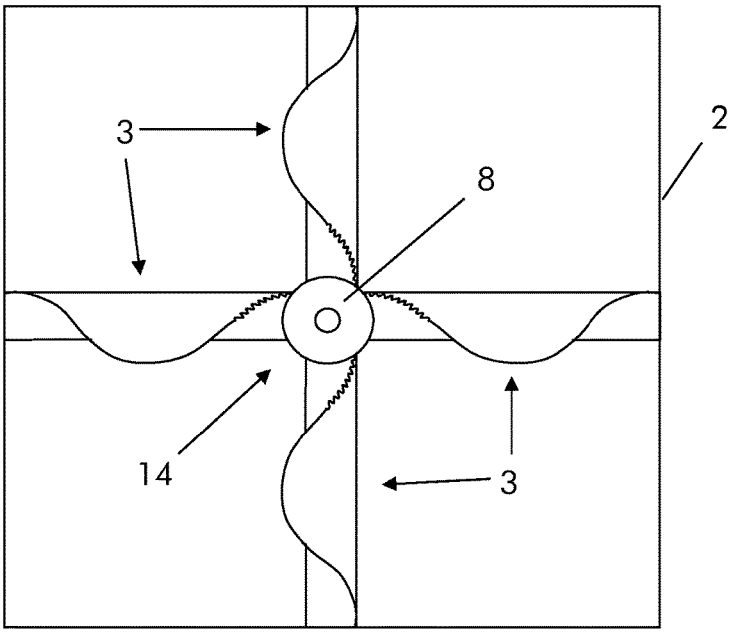
FIG. 14 shows an embodiment of a burner with a plurality of lobed shaped vortex generators converging to a connection position.

FIG. 14 shows a rear view of an example of the burner 1. In this example the burner 1 has four vortex generators 3 each with an elongated and streamline shape and with a leading edge 4 and a trailing edge 5. The vortex generators 3 have one end connected together at connection positions 14 and another end connected to the duct 2. Naturally even if the drawings only show one example, any number of vortex generators 3 is possible, such as three or more than four vortex generators.

The vortex generators 3 connected at connection positions 14 generate high turbulence around the connection positions 14, such that nozzles 8 can be advantageously provided at the connection positions 14. In addition or also as an alternative, the nozzles can be provided over the wall 11 at a distance from the trailing edge 5.

Figure 5:
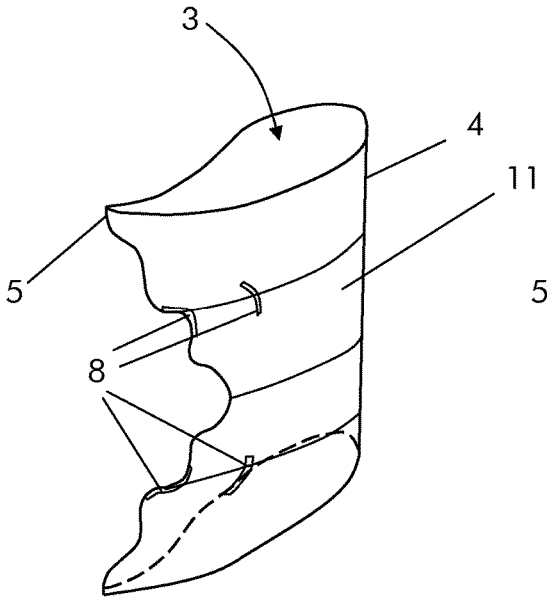
Figure 6:
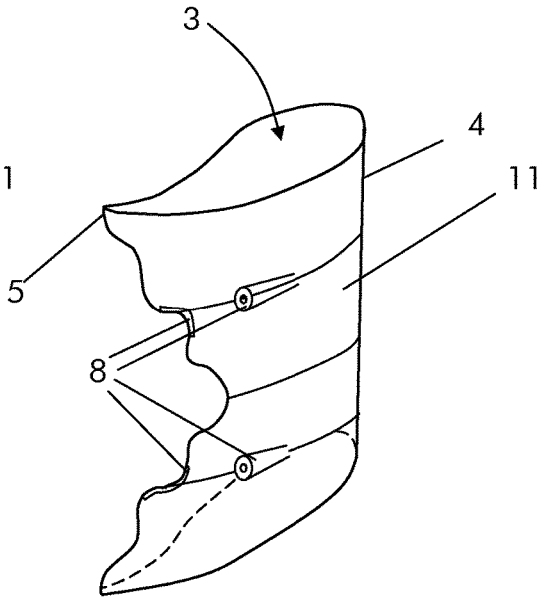

The nozzles 8 can be defined by one or more slots at the trailing edge 5 (FIG. 3) and/or by one or more slots on the wall 11 (FIG. 5) and/or by one or more injectors (such as round injectors) at the trailing edge 5 (FIG. 4) and/or by one or more injectors (such as round injectors) on the wall 11 (FIG. 6). Any combinations of slots and/or injectors at the trailing edge 5 and/or at on the wall 11 is possible.

Figure 1:
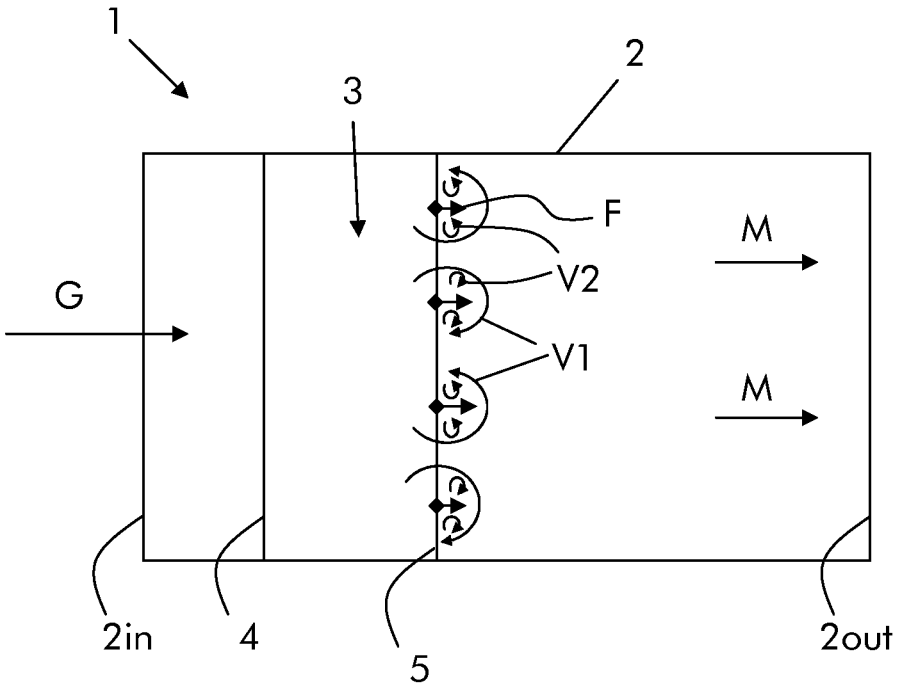
FIGS. 1 and 2 show a side view and a rear view of a burner.
Figure 2:
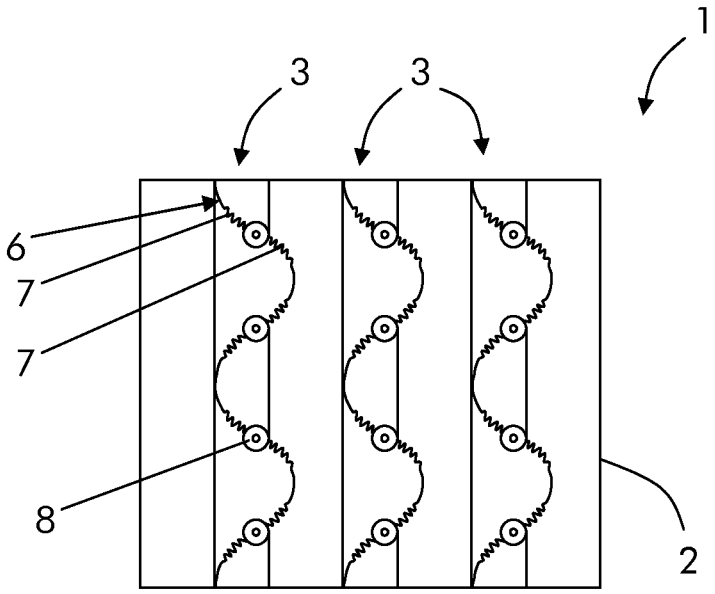
Figure 3:
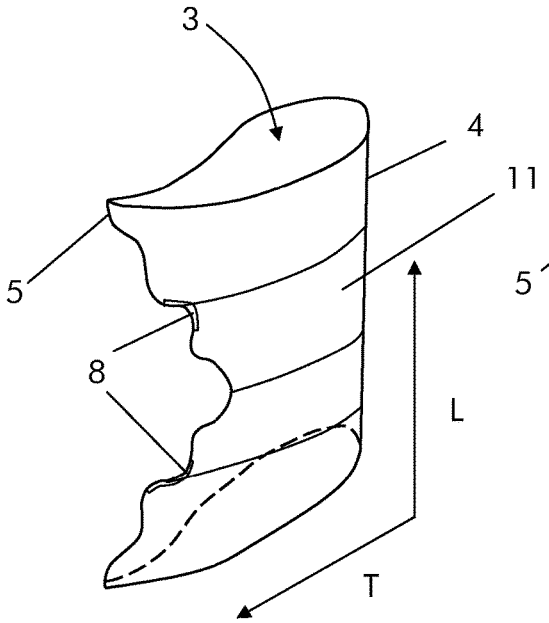
FIGS. 3 through 6 show a section of a vortex generator in different embodiments.
Figure 4:
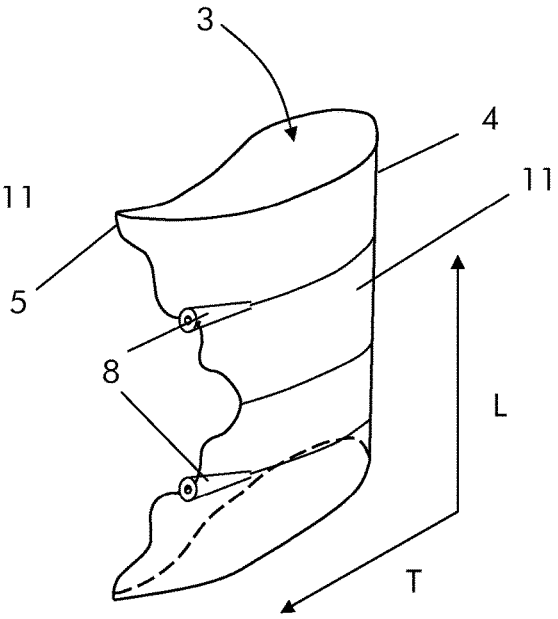

With reference to FIGS. 3 and 4, the nozzles 8 can have all the same position over the transversal axis T or they can have different positions over the transversal axis T; in this last case all combinations are possible, such that all nozzles 8 have different positions or the nozzles are divided in groups of nozzles wherein nozzles of the same group have the same position.

In addition, even if throughout the text specific reference to vortex generators having an elongated and streamline shape is made and these vortex generators are shown in the drawings with a straight longitudinal axis, it is clear that the vortex generators can have any shape and in particular they can have a curved shape defined by a curved longitudinal axis.

The nozzles 8 are provided with a central passage for oil or other liquid or gas fuel and an annular passage for carrier air or other gas.

The operation of the burner is apparent from that described and illustrated and is substantially the following.

The duct 2 has an inlet 2in and an outlet 2out.

The burner 1 can be supplied with fresh air or with hot gas still containing oxygen and coming from a gas turbine upstream of the burner 1 or from a combustion chamber (for example a combustion chamber of the gas turbine also having the burner 1) upstream of the burner 1. In the following reference to hot gas is made.

Hot gas G enters the inlet 2in and moves through the duct 2 and around the vortex generators 3, generating vortices. Fuel F is thus injected from the nozzles 8 into the vortices, such that hot gas G and fuel F are mixed, generating a mixture M that is combusted, typically in a combustion chamber downstream of the burner.

While licking the vortex generators 3, the first order lobed shape 6 of the vortex generators 3 induces first order vortices V1 into the hot gas G, these first order vortices V1 generate mixing on a large scale; likewise the second order (and possibly further order) lobed shape of the vortex generators 3 induces second order (and possibly further order) vortices V2 into the hot gas G; these second order (and possibly further order) vortices V2 generate mixing on a smaller scale than the first order vortices V1, such that intimate mixing can be quickly achieved.

Since the second and possibly higher order lobed shape are provided close to the nozzles 8 and since higher order vortices (i.e. smaller vortices that are generated by the higher order lobed shape of the trailing edge 5 and/or additional wall 10 like the vortices V2) cause local mixing where the fuel is available (i.e. close to the nozzles 8), quick mixing is achieved. In contrast second and possibly higher order lobed shape are not provided at parts of the trailing edge 5 apart from the nozzles 8 because the small vortices (like the vortices V2) generated by them would cause no or limited mixing of the hot gas G with fuel F, because fuel F is not available or is available only to a limited extend apart from the nozzles 8. On the other hand costs and complications to manufacture second and possibly further lobed order shape at parts of the trailing edge 5 apart from the nozzles 8 are saved.

The additional walls 10 contribute to the mixing by increasing the vortices and possibly inducing vortices of an order different from the order of the vortices induced by the wall 11 (in case the additional walls 10 have lobed shapes of an order different from the order of the wall 11); this can further improve mixing.

The configuration with a plurality of vortex generators 3 connected at connection positions 14 can be advantageously used not only for obtaining large turbulence around the connection position 14, but also to have a structure able to compensate for thermal expansion of the materials.

In addition the nozzles 8 located at different positions at the trailing edge 5 or upstream of the trailing edge 5 can be used to inject fuels having different reactivity.

Naturally the features described may be independently provided from one another.

In practice the materials used and the dimensions can be chosen at will according to requirements and to the state of the art.

REFERENCE NUMBERS

1 burner
2 duct
2in inlet
2out outlet
3 vortex generator
4 leading edge
5 trailing edge
6 first order vortex generator
7 second order vortex generator
8 nozzles
9 third order vortex generator
10 additional wall
10*a* leading edge
11 wall
14 connection position
F fuel
G hot gas
L longitudinal axis of the vortex generator
M mixture
T transversal axis of the vortex generator
V1 first order vortices
V2 second order vortices

The invention claimed is:

1. A burner of a gas turbine comprising:

a duct;

a vortex generator extending in the duct and comprising a leading edge and a trailing edge, wherein the trailing edge has a first lobed shape; and an additional wall that extends across a surface between the leading edge and the trailing edge of the vortex generator, wherein the first lobed shape is defined by a second lobed shape.

2. The burner of claim 1, wherein the vortex generator further comprises at least one nozzle for fuel injection connected to the vortex generator, wherein the second lobed shape is provided at a portion of the vortex generator that connects to the at least one nozzle.

3. The burner of claim 1, wherein the additional wall has a lobed shape connected to the vortex generator.

4. The burner of claim 3, wherein the additional wall is connected to the vortex generator at the at least one nozzle.

5. The burner of claim 4, wherein the additional wall is connected to the at least one nozzle.

6. The burner of claim 4, wherein the vortex generator has a second wall between the leading edge and the trailing edge, wherein the additional wall is connected to the second wall.

7. The burner of claim 3, wherein the additional wall has the first lobed shape and/or the second lobed shape.

8. The burner of claim 3, wherein the additional wall has at least one lobed shape different from the first and/or second lobed shape.

9. The burner of claim 1, comprising at least three vortex generators having one end connected together at a connection position and another end connected to the duct.

10. The burner of claim 9, comprising a nozzle at the connection position.

11. The burner of claim 2, wherein the at least one nozzle is provided at the trailing edge.

12. The burner of claim 2, wherein the vortex generator has a second wall between the leading edge and the trailing edge, wherein the at least one nozzle is provided on the second wall.

13. The burner of claim 2, wherein the second lobed shape of the trailing edge is at least partly defined by at least a third lobed shape; wherein the at least third lobed shape of the trailing edge is provided at the at least one nozzle.

14. The burner of claim 2, wherein the additional wall has a plurality of lobed shapes, wherein one of the plurality of lobed shapes is formed at the at least one nozzle.

15. The burner of claim 2, comprising a plurality of nozzles, wherein the plurality of nozzles have different positions over a transversal axis.

* * * * *